United States Patent [19]

Furgang

[11] Patent Number: 4,669,128

[45] Date of Patent: Jun. 2, 1987

[54] DUAL-PURPOSE ARTICLE

[76] Inventor: Marc D. Furgang, 23 Yorkshire Dr., Suffern, N.Y. 10977

[21] Appl. No.: 750,464

[22] Filed: Jul. 1, 1985

[51] Int. Cl.[4] ..... A41B 1/12

[52] U.S. Cl. ..... 2/69

[58] Field of Search ..... 2/69, 67, 114

[56] References Cited

U.S. PATENT DOCUMENTS 2,344,011 3/1944 Walsh ..... 2/69

2,420,344 5/1947 Alexander ..... 2/69

*Primary Examiner*—Doris L. Troutman

*Attorney, Agent, or Firm*—Philip Furgang

[57] ABSTRACT

A string secured at each end to a marginal edge of a rectangular towel. The string, when drawn upon, pulls on the opposing marginal edges of the towel to form, between the string and the towel, an opening to receive the head and neck of a wearer. VELCRO fasteners, adjacent the side opposed to the marginal edge, are used to secure the towel about the user to thereby form a robe.

18 Claims, 5 Drawing Figures

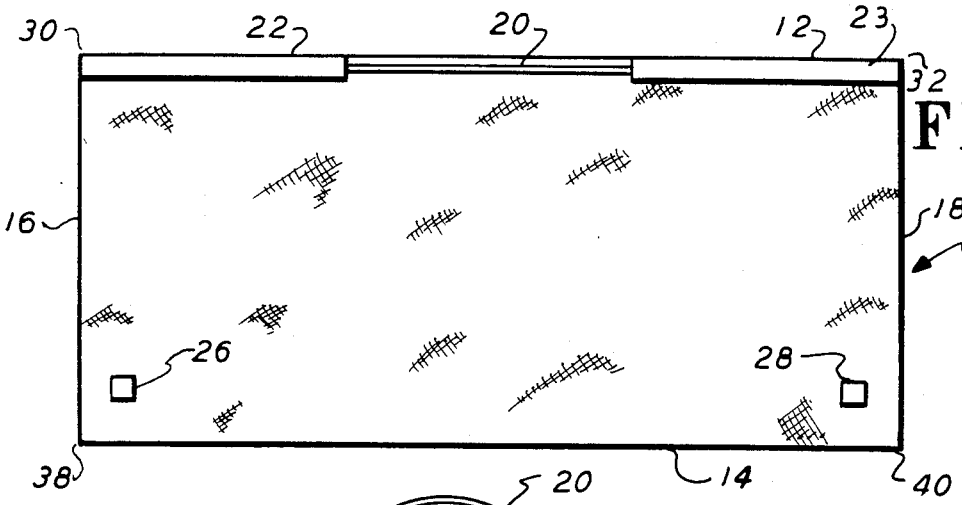
FIG. 1
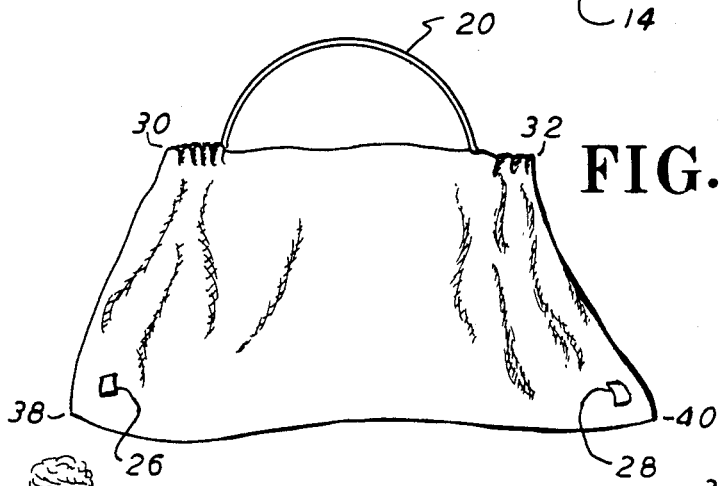
FIG. 2
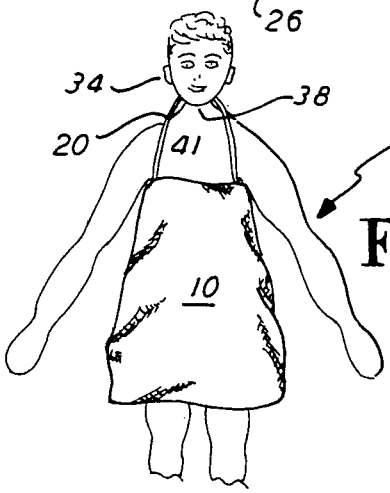
FIG. 3
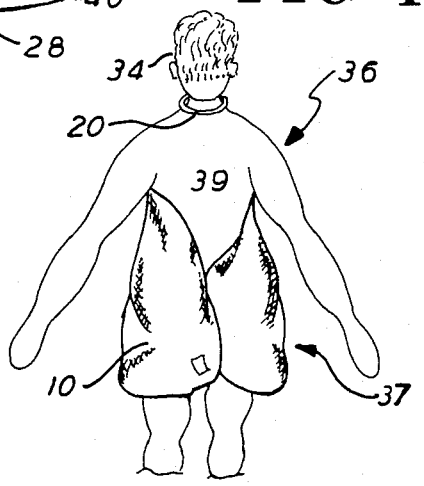
FIG. 4
FIG. 5
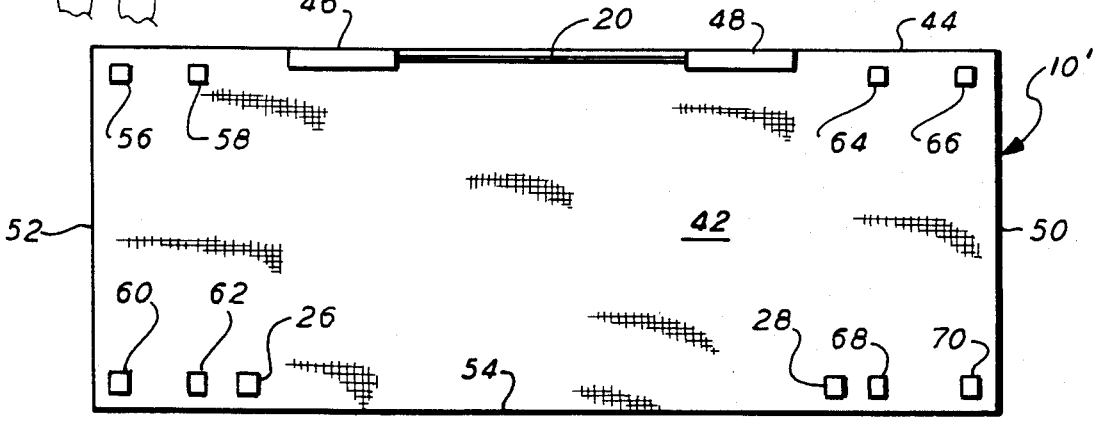

DUAL-PURPOSE ARTICLE

BACKGROUND OF THE INVENTION

This invention relates to a dual-purpose article and more particularly, is directed to an article of clothing which may serve both as a robe and another purpose. The other purpose for the article may, by way of example, be a towel, beach blanet, picnic cloth, or the like.

Numerous combined bathrobe towel-like devices have been suggested over the years. Thus, for example, Hoyme in U.S. Pat. No. 1,497,685, entitled "Combined Bathrobe and Towel", describes a rectangularly-shaped towel which has a cenrally disposed rectangular opening to fit over the head of a user serape style. Narrow banks or strips are defined along opposed sides of the cloth. When the cloth is slipped over the head of the user, two strips are used as a belt to secure the garment.

Dike, in U.S. Pat. No. 3,013,274, entitled "Convertible Towel Costume", provides a serape-type towel and provides snaps for joining along the side to enclose the wearer.

Nyhagen in U.S. Pat. No. 1,916,068, entitled "Bathing Accessory", provides for a means for securing a towel draped over a person's shoulders. To accomplish this, snaps are located along a towel. Once the towel is draped over the shoulders, the snaps are engaged between the arms and body of the user to return the towel in position.

Hoyme, in U.S. Pat. No. 1,432,249, entitled "Article of Manufacture", discloses another serape-type towel garment with snaps at the sides.

The disadvantage of most of the robe to towel prior art devices is that they each attempt to make a robe-like device serve as a towel or blanket. Thus, each starts by providing means for receiving or accommodating the arms and neck of a user. This has led to towels or blankets with strips and holes cut in them.

SUMMARY OF THE INVENTION

It is an object of this invention to provide a large cloth which may be used for such purposes as a picnic blanket, a beach towel, or the like and also as a robe.

It is another object of this invention to provide a towel, blanket, or cloth in which the surface area may be, if desired, substantially uninterrupted by openings or fastener projections, which would impair its use, and which includes a retractable opening for receiving a head and fasteners disposed to form a robe.

It is yet another object of this invention to provide a convenient towel-like device which will conveniently serve both the purposes of a towel or blanket and a robe.

In accordance with the teachings of this invention, there is provided an article adapted for dual use, including use as a robe. This device comprises a large piece of cloth, having predetermined dimensions. There is provided a marginally attached retractable head-engaging means. The head-engaging means is fixedly secured to a marginal edge of the cloth, such that in a first position. The cloth may be disposed with the head-engaging means fully withdrawn. A second position of the head-engaging means is open to thereby form between the marginal edge and the head-engaging means an opening so as to receive the head and neck of a user. In addition, means for releaseable attachment are provided and are secured to the cloth. These attachment means are spaced from the head-engaging means such that when the head-engaging means is disposed about the neck of the user, the cloth may be wrapped about the user and the attachment means releaseably engaged to thereby envelop the user so as to form a robe.

BRIEF DESCRIPTION OF THE DRAWING

FIG. 1 is a planar view of a device constructed in accordance with this invention;

FIG. 2 is a planar view of the device of this invention in the head-engaging position;

FIG. 3 is a front view of the device of this invention being worn by a by a user;

FIG. 4 is a back view of the device of this invention as worn by a user; and FIG. 5 is another embodiment of this invention.

DESCRIPTION OF THE PREFERRED EMBODIMENT

In the general concept of this invention, there is provided a large piece of cloth which may serve as a blanket, towel, or picnic spread. The general use of the cloth will be dependent upon its size and the type of material used.

Along one marginal edge of the cloth is a retractable head-engaging means. When used as a towel, blanket, or the like, the head-engaging means is withdrawn into the marginal edge so that it is unobtrusive. When it is desired to use the cloth as a robe, the user pulls out the head-engaging means from the marginal edge, forming an opening between the edge and the head-engaging means for receiving the head and neck of the user. The cloth is now hanging from the head of the user. The cloth is then enveloped about the body of the user. Engaging means, along the lower part of the cloth, are used to secure the cloth about the body, thereby forming a robe. The approach of this invention, as distinguished from the prior art, is that a cloth is converted to a robe. In the prior art, the emphasis appears to have been on converting a robe into a blanket or towel.

Turning now to the drawing, we find a piece of cloth 10. This piece of cloth 10 may be large enough to serve as, for example, a towel that one customarily uses in a shower or as a beach blanket or the like. As such, the cloth 10 may have any conventional shape. In this example, the cloth is rectangular and made of a towel-like material. It has a pair of parallel long dimensioned sides 12 and 14 and shorter dimensioned sides 16 and 18. If used as a towel 10 may be made of any convenient well-known material such as terry cloth or the like.

In the device of this invention, the head-engaging means may be in the form of a string 20 combined with one side of the cloth 10. The cloth 10 may have a hem. The string or drawstring 20 may be disposed along one of the sides 12, 14, 16, or 18 of the cloth 10. In this example, it is disposed along one of the longer sides 12. The opposed ends of the string (not visible in FIG. 1) may be secured adjacent the opposed ends 16 and 18 of the towel 10 by any well-known means such as glue, stitching, or, in the case of plastic, heat sealing. The string 20, which may be of ordinary cotton or other similar material, may be enclosed within a hem 22 which extends part of the way along the marginal edge 12 from the end 16 of the towel 10. In the same manner, the opposed end of the string 20 adjacent the side 18 is similarly enclosed in a hem 23 from end 18.

Attached to the cloth 10 adjacent the lower longer edge 14 and the opposed shorter ends 16 and 18 may be fastening means 26 and 28. In the context of this invention, any convenient fastening means such as snaps or the like may be used. Preferably, these fastening means 26 and 28 may be Velcro matching connectors. The connectors 26 and 28 may be attached to the cloth 10 by any well-known means, such as stitching or the like.

When not in use, the drawstring 20 is an integral part of the marginal edge 12 of the cloth 10. Thus, the cloth 10 may conveniently serve as a towel, beach blanket, or some other desired use.

When the drawstring 20 is pulled upwardly, it may gather or pull the corners [defined by the junction of marginal edges 12 and 16 (i.e., 30) and 12 and 18 (i.e., 32)]. Thus, corners 30 and 32 may be pulled toward one another, thereby making the shape of the cloth 10 somewhat A-shaped. The pulled drawstring 20 then forms a loop opening between it and the marginal edge 12. If the string 20 is disposed about the head 34 of a user 36 (FIGS. 2 and 3), the cloth 10 is caused to hang from the neck 38 of the user 36. The other sides 16 and 18 of the cloth 10 may then be conveniently wrapped about the body 37 of the user 36 and secured by means of the velcro attachments 26 and 28 to thereby form a robe. Depending upon the location of the connectors 26 and 28 and the dimensions of the cloth 10, the cloth-robe 10 may be secured at the back 39 (FIG. 3) or front of the user 36.

In use, one may come out of a shower and reach for a towel 10 to dry oneself off. To leave the shower room, one may then pull upon the string 20, place it about one's neck, and secure it about the lower part of the body by means of the fasteners 26 and 28 (FIGS. 2 and 3).

In another embodiment, similar parts are provided with the same identifying members to indicate a similar or related function. Thus, the cloth 10 may be so large as, for example, to serve as a picnic blanket. As indicated above, the string 20 may be disposed along a longer side 44 of the rectangular blanket 42. A hem enclosure 46 and 48 may be provided along the marginal edge 44 to enclose an attached string 20. The ends of the string 20, as before, may be secured to the blanket 42. The hems 46 and 48, however, may be spaced from the shorter sides 50 and 52 of the blanket 42. As with the first embodiment 10, fastening means, such as Velcro connectors 26 and 28 may be provided along the lower edge 54 of the towel or blanket and the bottom edge 54. Additional fasteners, such as at 56 and 58, 60 and 62, 64 and 66, and 68 and 70, may also be provided so as to shorten the blanket 42. Thus, if the blanket 42 proved too long, it may, for example, be folded up and secured by the fasteners 64 and 66, 68 and 70, 56 and 58, and 60 and 62.

It will be understood that the drawstring 20 may be located along a shorter edge 50. The connectors 56 and 58, 60 and 62, along one side 52 may be provided to shorten the length rather than the width of the cloth 10.

What is claimed:

1. An article adapted for dual use, including use as a robe about a user comprising:

(a) a piece of cloth of predetermined dimensions;

(b) head-engaging means secured to a first marginal edge of said cloth such that in one position, said head-engaging means forms an integral part of said cloth; in a second position, said head-engaging means being pulled from said cloth so as to form, between said head-engaging means and said marginal edge, a space capable of receiving the head and neck of the user; and (c) means for releaseable attachment secured to said cloth and spaced from said head-engaging means, said cloth being capable of being wrapped about the lower part of the body of the user to thereby substantially envelope the user and said attachment means being engaged to thereby form a robe.

2. An article as recited in claim 1 wherein said head-engaging means comprises a string secured at opposed ends to said first marginal edge.

3. An article as recited in claim 2 further comprising hem means secured about each of said opposed ends of said string such that said string forms a drawstring.

4. An article as recited in claim 3 wherein said cloth having a substantially uninterrupted surface.

5. An article as recited in claim 3 wherein said cloth is substantially rectangular and said attachment means comprises matching connectors spaced along a marginal edge opposed to said first marginal edge.

6. An article as recited in claim 5 wherein said rectangle having one pair of sides longer than the other pair of sides and said hem means comprises two hems, each hem enclosing an end of said string; said marginal edge between said hems defining one edge of said head receiving space.

7. An article as recited in claim 6 wherein said first marginal edge being said longer side.

8. An article as recited in claim 7 wherein said connectors are velcro connectors.

9. An article as recited in claim 7 wherein said connectors are snaps.

10. An article as recited in claim 6 wherein said first marginal edge being said shorter sides.

11. An article as recited in claim 10 wherein said connectors are velcro connectors.

12. An article as recited in claim 10 wherein said connectors are snaps.

13. An article as recited in claim 7 further comprising second attachment means for selectively folding said cloth along at least one of said sides to reduce one of the dimensions of said cloth.

14. An article as recited in claim 13 wherein said second attachment means comprises velcro connectors.

15. An article as recited in claim 13 wherein said second attachment means comprises snaps.

16. An article as recited in claim 10 further comprising second attachment means for selectively folding said cloth along at least one of said sides to reduce one of the dimensions of said cloth.

17. An article as recited in claim 16 wherein said second attachment means comprises velcro connectors.

18. An article as recited in claim 16 wherein said second attachment means comprises snaps.

* * * * *